United States Patent [19]

Riffe et al.

[11] 4,060,342

[45] Nov. 29, 1977

[54] VANE ASSEMBLY FOR ROTARY COMPRESSOR

[75] Inventors: Delmar R. Riffe; Robert R. Young, both of Franklin Borough, Pa.

[73] Assignee: Westinghouse Electric Corporation, Pittsburgh, Pa.

[21] Appl. No.: 697,164

[22] Filed: June 17, 1976

[51] Int. Cl.[2] ..... F04B 49/00; F01C 19/04; F04C 27/00

[52] U.S. Cl. ..... 417/284; 418/139; 418/147

[58] Field of Search ..... 417/284, 310; 418/139, 418/147, 148, 248, 249, 266–268

[56] References Cited

FOREIGN PATENT DOCUMENTS 687,573 2/1940 Germany ..... 418/148

*Primary Examiner*—John J. Vrablik
*Attorney, Agent, or Firm*—E. C. Arenz

[57] ABSTRACT

A vane assembly for a rotary compressor is provided having a shoe for sliding against a relatively moving surface and carried on a blade edge in a cylindrical pivot type joint. The shoe is generally channel-shaped in transverse cross-section and has openings in both of the opposite legs of the shoe. The cylindrical-shaped edge of the blade upon which the shoe is mounted is dimensioned relative to the socket of the shoe receiving the edge to permit movement of the cylindrical edge in a direction away from the web of the shoe under a condition of high differential pressure across the shoe so that a relief passage from the high pressure space on the one side of the shoe to the low pressure space on the other side of the shoe is provided by the openings in the legs of the shoe and the cylindrical edge moved apart from the web of the shoe. The arrangement according to the invention promotes stability of the shoe on the cylindrical edge and prevents the possibility of the imposition of a turning moment upon the shoe which would result in damage to the shoe or other parts.

3 Claims, 4 Drawing Figures

VANE ASSEMBLY FOR ROTARY COMPRESSOR

CROSS-REFERENCE TO RELATED APPLICATIONS

Young U.S. patent application Ser. No. 697,099, filed June 17, 1976, is a related application in that it discloses and claims the basic invention upon which this invention is considered to be an improvement.

BACKGROUND OF THE INVENTION

1. Field of the Invention

The invention pertains to the art of vane assemblies for rotary compressors.

2. Description of the Prior Art

As is set forth in the noted related patent application, vane assemblies which include a blade portion and a pivotal shoe carried along an edge of the blade are shown in a number of patents. The related patent application discloses an arrangement in which the cylinder and socket joint formed by the blade and shoe is configured so that the shoe includes the socket portion of the joint, while the cylindrical portion of the joint is provided on the edge of the blade. The advantage of this arrangement over the reversed parts arrangement of the prior art is that a superior hydrodynamic lubricating film between the shoe and the surface against which it bears can be obtained as a result of reduced loading and a reduced turning moment imposed upon the shoe and tending to pivot the shoe around to a point at which the shoe may break or other damage may occur.

The arrangement of the invention according to this application is considered to be superior to those disclosed in the related application in that significantly higher pressure differentials between the compression space and the suction space in a rotary compressor can be accommodated with the present invention.

SUMMARY OF THE INVENTION

The aim of the invention is accomplished by the provision of an arrangement of shoe and blade which results in a relief passage opening under a condition of high differential pressures which would tend to create a turning moment potentially destructive of the shoe. This is accomplished in the type of vane assembly having a shoe encompassing the blade edge in a cylindrical pivot type joint by providing relief openings in both sides of the shoe and dimensioning the cylindrical edge on the blade relative to the shoe to permit movement of the cylindrical edge within the socket of the shoe to a position in which the relief openings in the opposite sides of the shoe are in communication with each other. In other words, by providing the openings in the two opposite legs of the shoe, and a cylindrical edge dimensioned so that it can "lift" away from the web of the shoe under a condition of high differential pressure, the relief passage through the shoe is opened.

DESCRIPTION OF THE PREFERRED EMBODIMENT

As in the case of the invention of the related patent application, the invention of this application may be used in any of various forms of rotary compressors. For purposes of the present description, the type of rotary compressor in which the invention is incorporated is one in which the rotor portion of the compressor is of elliptical form in cross-section with the rotor being rotated within a circular chamber.

Figure 1:
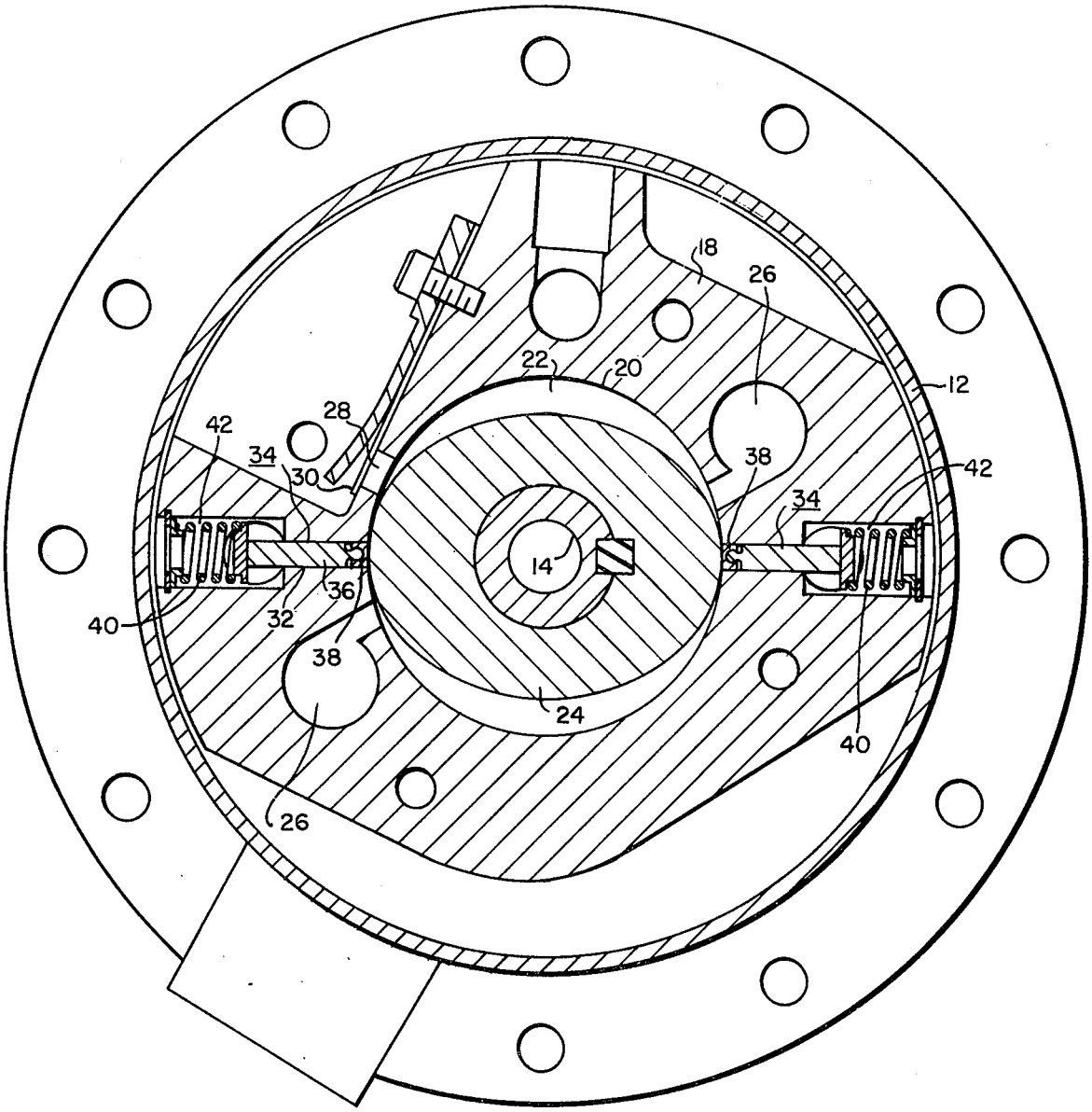
FIG. 1 is an offset horizontal section through one form of rotary compressor to which the invention may be applied.

Referring now to FIG. 1, the rotary compressor generally designated 10 is provided in the bottom portion of a hermetic can 12 which has an electric motor (not shown) in its upper portion for driving the rotary compressor through the central shaft 14.

The housing 18 has interior cylindrical walls 20 forming the chamber 22 into which the elliptical rotor 24 is received. The major crosswise dimension of the rotor corresponds closely to the diameter of the cylindrical chamber while the minor crosswise dimension is considerably less to form with the cylinder walls of the chamber the spaces within which the suction and compression occur as the rotor rotates.

The housing has formed in it the usual suction gas inlets and ports 26 (two of which are shown in FIG. 1) and discharge ports 28 (only one of which is seen in FIG. 1 because of the offset section). A discharge valve 30 may be provided for each of the discharge ports 28.

The housing is provided at diametrically opposite points with a pair of slots 32 which extend for the length of the housing. These slots receive the vane assemblies generally designated 34 which basically comprise a blade portion 36 and a shoe portion 38. Compression springs 40 are provided in two radially extending bores 42 at the outer ends of the blades 36. These springs bias the vane assemblies radially inwardly to press the shoes against the periphery of the rotor while the compressor is at rest. However, the major biasing force when the compressor is operated is obtained from the interior of the can 12 being at high side or condenser pressure which is communicated to the bores 42 and which urge the vane assemblies radially inwardly. As the rotor 24 turns, the vane assemblies reciprocate back and forth to follow the changing radius of the periphery of the elliptical rotor. As such, the vanes separate each of the two spaces defined between the flattened sides of the rotor and the cylindrical wall 20 of the housing into suction and discharge spaces, as in any conventional rotary compressor with reciprocating vanes.

Figure 2:
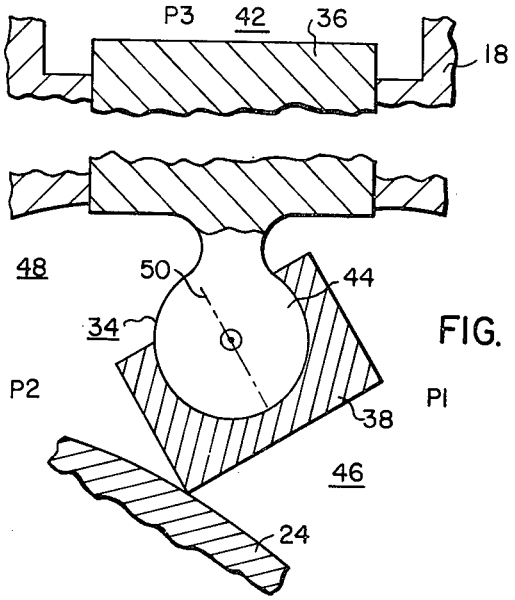
FIG. 2 is a fragmentary, partly-broken sectional view of one form of shoe and blade arrangement as disclosed in the related patent application and showing the shoe in a failure mode.

FIG. 2 is an illustration of one of the embodiments of the related application in a failure mode. In FIG. 2, the rotor is assumed to rotate in a clockwise direction with the space 46 to the right of the vane assembly and carrying the indication P1 being at suction pressure, the space 48 to the left of the vane assembly and carrying the legend P2 having pressures varying from suction to discharge, and the space in the bore 42 into which the proximal end of the vane projects carrying the legend P3 being at high side or condenser pressure. As the elliptical rotor 24 rotates, the pressure P2 in space 48 will vary while the pressures P1 in space 46 and P3 in the bore 42 will remain substantially constant. Additionally, the curvature of the surface of the rotor will change continuously from the relatively flatter surfaces on the flattened sides of the rotor to the relatively sharper curvature surfaces on the ends of the major diameter of the rotor. As a result of the changing differential pressures and changing curvatures of the surfaces, the shoe 38 will pivot about the axis 0 indicating the longitudinal axis of the cylindrically shaped edge 44 of the blade.

The condition which leads to the possibility of a shoe 38 pivoting to the disposition shown in FIG. 2 results from a very high pressure condition P2 in the compression space 48 typically being due to a liquid slugging condition. An explanation of the various forces involved and calculations under various pressure conditions is to be found in the related patent application to which reference should be had for details. It will suffice for present purposes to note that a shoe 38 will move to the disposition shown in FIG. 2 when the restoring moment comprising the product of the reactive force of the rotor upon the shoe and the eccentricity (the distance from a plane indicated by line 50 to the line of application of the reactive force) is such that the eccentricity exceeds half the width of the shoe. It will be appreciated that when a shoe is pivoted to a position as shown in FIG. 2, because of the high differential pressure between the spaces 48 and 46, that the shoe 38 is subject to failure and there is no possibility of a hydrodynamic lubricating film of any value existing.

In accordance with the invention, the vane assembly is configured in a way that a relief passage is provided which operates under a condition of the pressure differential between the two spaces 48 and 46 exceeding a predetermined value.

Figure 3:
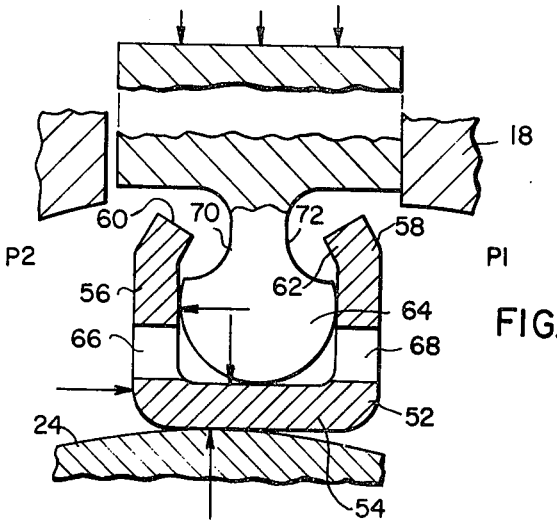
FIG. 3 is a fragmentary, partly-broken sectional view of a shoe and blade arrangement according to the invention in a position during normal operation.
Figure 4:
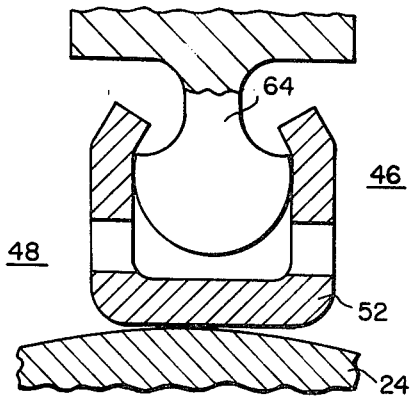
FIG. 4 is a fragmentary sectional view of the arrangement of FIG. 3 in a position in which a relief passage has been opened as a result of a high differential pressure.

Referring to FIGS. 3 and 4, the pivotal shoe 52 is of generally channel-shape in transverse section and includes a web portion 54 and opposite leg portions 56 and 58, each of the leg portions including marginal edge portions 60 and 62 which are spaced apart less than the diameter of the semi-cylindrical blade edge 64 to hold the shoe in captured relation on the edge 64. Both of the legs 56 and 58 include a series of relief openings 66 and 68, respectively, spaced apart along the length of the shoe.

The semi-cylindrical edge 64 is also relieved along its length as indicated by the arcs 70 and 72 so that the dimension from the inside surface of the web 54 up to the inwardly-directed marginal edge portions 60 and 62 is somewhat greater than the distance from the base of the semi-cylindrical edge 64 to its relieved portions. With these dimensional relationships, the blade is capable of lifting away from the shoe as illustrated in FIG. 4 so that the relief passage is opened as there indicated. This permits a cross-flow of refrigerant fluid from the compression space 48 to the suction space 46 and avoids the possibility of the shoe being tipped as is the case with the embodiments described in the related patent application.

While it is not considered necessary to give a detailed analysis of the various forces under different operating conditions, in general it may be said that the blade edge will lift from the shoe when the upward force determined from the differential pressure between P2 and P3 exceeds the downward force determined from the differential pressure between P3 and P1.

We claim:

1. In a blade and shoe vane assembly for a rotary device in which the shoe socket encompasses the blade edge in a cylindrical pivot type joint, the improvement comprising means for venting from the space on one side of said shoe to the space on the other side under conditions of the pressure differential between the two sides exceeding a predetermined value, comprising relief openings in both sides of said shoe, and said blade edge is smaller than said shoe socket to permit movement of said edge within the socket to a position in which said relief openings are in communication with each other, said blade edge bearing against the base of said shoe socket under normal operating conditions in which the pressure differential is less than said predetermined value so that under the normal operating conditions communication between said relief openings is blocked.

2. In a blade and shoe vane assembly for a rotary compressor in which the shoe socket encompasses the blade edge in a cylindrical pivot type joint, the improvement comprising means forming a pressure relief passage between the spaces on opposite sides of the shoe comprising relief openings in both of the opposite parts of the shoe and a semi-cylindrical edge on the blade which is smaller than the shoe socket to permit movement of the edge in a direction away from and out of contact with the wall joining the opposite parts of the shoe to thereby place said relief openings in communication with each other, said edge normally being in contact with the joining wall of the shoe under conditions of differential pressure in a given range between the spaces on the opposite sides of the shoe, and moving out of contact under conditions of differential pressure exceeding the given range.

3. In a rotary compressor vane assembly of the type having a shoe with a socket pivotally mounted on a cylindrically shaped edge of a blade, the improvement comprising:

said shoe is generally channel-shaped in transverse section with inwardly directed marginal edge portions on the opposite legs to hold said cylindrically shaped edge in captured relation therewith, both of said legs having a plurality of openings in their portions adjacent the web of the channel, and said cylindrically shaped edge is diametrically smaller than the width of the socket and has a height less than the height of said legs, to permit said edge to move to a position in which said edge is spaced apart from the inner surface of the web of said shoe to open a relief passage between the opposite sides of the shoe.

* * * * *